US005143811A

United States Patent [19]

Itakura et al.

[11] Patent Number: 5,143,811

[45] Date of Patent: Sep. 1, 1992

[54] TONER COMPOSITION FOR DEVELOPING AN ELECTROSTATIC LATENT IMAGE AND AN IMAGE-FORMING METHOD USING THE SAME

[75] Inventors: Takayuki Itakura, Moriguchi; Takashi Teshima, Ibaraki; Tomohide Iida, Minamikawachi; Hirofumi Horio, Sakai, all of Japan

[73] Assignee: Mita Industrial Co., Ltd., Osaka, Japan

[21] Appl. No.: 597,233

[22] Filed: Oct. 15, 1990

[30] Foreign Application Priority Data

Oct. 16, 1989 [JP] Japan ..... 1-269544
Oct. 31, 1989 [JP] Japan ..... 1-285796

[51] Int. Cl.[5] ..... G03G 9/08
[52] U.S. Cl. ..... 430/111; 430/126
[58] Field of Search ..... 430/106.6, 110, 111, 430/903, 126

[56] References Cited

U.S. PATENT DOCUMENTS 3,819,367 6/1974 Chatterji et al. ..... 96/1
3,900,588 8/1975 Fisher ..... 427/19
4,868,084 9/1989 Uchide et al. ..... 430/110
4,985,327 1/1991 Sakashita et al. ..... 430/110

FOREIGN PATENT DOCUMENTS 0237038 9/1987 European Pat. Off. .
0347918 12/1989 European Pat. Off. .

OTHER PUBLICATIONS

Japanese Patent Abstract, JP 62-10654 (Jan. 19, 1987), vol. 11, No. 181 (P585)[2628] Dated: Jun. 11, 1987.

*Primary Examiner*—John Goodrow
*Attorney, Agent, or Firm*—Armstrong & Kubovcik

[57] ABSTRACT

The present invention provides a toner composition comprising a toner and a hydrophobic silica composed of a fine powder of silica treated with a compound having a polymethylsilyl group in the molecule.

7 Claims, 4 Drawing Sheets

DISTRIBUTION OF
TONER RELEASE

DISTRIBUTION OF
TONER RELEASE

TONER COMPOSITION FOR DEVELOPING AN ELECTROSTATIC LATENT IMAGE AND AN IMAGE-FORMING METHOD USING THE SAME

BACKGROUND OF THE INVENTION

1. Field of the Invention

The present invention relates to a toner composition to be used for an image forming apparatus utilizing the electrophotographic method, and more particularly to a toner composition which is good in charge stability, fluidity and delivering ability to a developing apparatus, and to an image forming method utilizing the same.

2. Description of the Prior Art

An image forming apparatus utilizing the electrophotographic method is well known.

In the image forming apparatus utilizing the electrophotographic method, images are generally formed onto a sheet of copy paper through the following processes.

After uniformly charging a photoconductor which serves as an image-holding body, images are exposed onto the surface of the charged photoconductor. A latent image is formed by attenuating electrostatic charges during the exposure of light. Then the electrostatic latent images are visualized by developing with toner to form a toner image. The toner images are transferred onto a sheet of copy paper.

The above-described developing processes are classified into two categories; one is the two component development method using a developing agent in which a carrier composed of a magnetic material and a toner are mixed together, and the other is the single component method utilizing a toner only.

In the two component development method, an appropriate charge is imparted to the toner by mixing with the carrier. In the single component development method, on the other hand, a predetermined charge is given to toner by the friction among the toner particles, or by contact with friction-charging parts, such as the development sleeve, brush-cutoff regulating sleeve or toner press-adhering blade. As a result of this charging phenomena, the toner particles adhere onto the photoconductor by an electrostatic force acting between the charged toner particles and the electrostatic charge composing aforementioned electrostatic latent images, thereby forming visible images.

The two component development method is described referring to FIG. 5. The image forming apparatus used for the two component development method comprises a photoconductor 10, a developing apparatus 5 and a toner container 1. A stirring roller 7 to mix the developing agent D homogeneously, and a development sleeve 8 are disposed inside a developing apparatus 5. A development sleeve 8 is composed of a magnet or the like, in the vicinity of which a magnetic brush composed of a chain-like array of the carrier in the developing agent D is formed. Toner T adheres onto the carrier by frictional charging. The electrostatic latent images formed on the photoconductor 10 through the charging and exposure processes are developed by the above-described toner T. The toner image corresponding to the electrostatic latent image is transferred onto the copy material such as a sheet of copy paper, followed by fixing on the copy material by the fixing equipment such as a fixing roller (a heated roller or a press roller).

When the toner concentration in the developing agent D is decreased during the operation, the following system operates within the entire system to keep the predetermined toner concentration in the developing apparatus 5.

A magnetic sensor 9 to detect the toner concentration in the developing agent D is equipped in the developing apparatus 5, and the magnetic sensor 9 is linked with the driving part of the toner-supply mechanism 11 disposed to the lower part of the toner container 1. When the toner concentration in the developing agent D is decreased, the magnetic sensor 9 transfers a signal to the driving part of the toner-supply mechanism 11, thereby feeding down a predetermined amount of toner T from the toner container 1 to the developing apparatus 5 by rotating the toner-supply mechanism 11.

Good fluidity of the toner T is required to form an excellent quality of images in the two component development method. That is, if fluidity of the toner T in the developing apparatus 5 is insufficient, output of the magnetic sensor 9 will fluctuate and charging will be unstable, thereby causing image overlapping and scattering of the toner particles. Particularly, if a toner-supply mechanism 11 by which toner is supplied to the developing apparatus 5 from the remote position using spiral screw 2 as is shown in FIG. 1 is applied, efficiency of toner feed to the developing apparatus 5 will be decreased.

Addition of fine particles of silica has been suggested to improve the fluidity of the toner. Since fluidity of a toner composition including fine particles of silica is rather good, feeding efficiency of the toner composition from the toner container 1 to the developing apparatus 5 and charge stability of the toner composition can be improved.

In the above-described toner composition, however, fluidity of the composition is still unsatisfactory when micro-particles of the toner having the grain diameter of 10 μm or less are used to realize a high quality of images, or when formation of the images is performed under the circumstances of high temperature and high humidity. Some problems arise in that feeding performance from the toner container 1 and charging stability decreased.

A laser printer, a LED printer and the like have been developed in recent years, wherein the image scanning part and the image output part are separated from each other. In these apparatuses, a reversed development method, i.e., the toner is made to adhere to the portions where the charge at the portions of the image exposure has been attenuated, is adopted (in contrast to the above, where toner is made to adhere to the portions where charge still remains in the normal development method).

In such a reversed development method, the images are exposed onto the photoconductor by a laser output of the digital processed image signals. In these methods, gradation is expressed by the proportion of the area in which the latent images are reproduced. A delicate gradation of the images cannot be expressed or a fine resolution of the line images cannot be reproduced precisely if the particle size of the toner is not uniform. Moreover, when the latent digital images are subjected to reversed development, a lack of the images or irregularity in the image concentration will occur if the distribution of the toner in the magnetic brush formed on the development sleeve is not uniform. Therefore, the fluidity of the developing agent, particularly the delivering property of the developing agent on the development sleeve, should be uniform.

A bias potential imposed on the development sleeve plays as a driving force for the development by the toner in the reversed development method. Since fluctuations in the toner charge will result in the adhesion of the toner to the portions where images are not formed, the amount of the charges on the toner should be controlled precisely.

A photoconductor comprising an organic photoconductive layer has been frequently used for the image forming apparatus in recent years. In this case, a "filming phenomena" (a phenomena in which the toner adheres on the surface of the photoconductor forming a film) tends to occur by repeating development because of a high affinity between the resins forming a photoconductive layer and the toner. Consequently, a toner composition exhibiting improved cleaning performance is required.

SUMMARY OF THE INVENTION

The toner composition of the present invention, which overcomes the above-discussed and numerous other disadvantages and deficiencies of the prior art, comprises a toner and a hydrophobic silica comprising fine particles of silica treated with a compound having a polymethylsilyl group in the molecule, wherein the toner composition is used for the development of the latent images formed on the image-holding body.

In a preferred embodiment, the hydrophobic silica is contained in the range of 0.05 to 2 parts by weight per 100 parts by weight of the toner.

In a preferred embodiment, the toner composition further comprises fine particles of hydrophilic alumina.

In a preferred embodiment, the proportion of the hydrophobic silica to the hydrophilic alumina in the toner composition is in the range of 1:0.2 to 1:3.

In a preferred embodiment, the mean particle size of the toner is in the range of 6 to 10 μm, and the particle size of 70 wt % or more of the toner distributed is in the range of 0.6 to 1.2 times of the mean particle size.

In the preferred embodiment, the proportion of the toner particles having a particle size of less than 5 μm in the toner composition is 10 wt % or less, and the proportion of the coarse particles having a particle size of 16 μm or more in the toner composition is 2 wt % or less.

In a preferred embodiment, the compressibility of the toner composition is in the range of 35 to 40%.

The image forming method in the present invention comprises the steps of imparting a charge on the image-holding body by a charging method, forming an electrostatic latent image on the image-holding body by exposing an image by a digital exposure method on the image-holding body imposed by a charge, converting a electrostatic latent image on the image-holding body into a toner image by a development method containing a toner composition, and transferring the toner image on the image-holding body to a copy material by a transfer means, wherein the toner composition comprises a toner and a hydrophobic silica comprising a fine powder of silica treated with a compound having a polymethylsilyl group in the molecule.

In a preferred embodiment, the image-holding body is an organic photoconductive material.

Thus, the invention described herein makes possible the objectives of:

(1) providing a toner composition having good fluidity even when a toner with fine particle size and relatively inferior fluidity is used, and the images are formed under the circumstances of high temperature and humidity;

(2) providing a toner composition which can attain the objectives of stability in toner feeding, stability in the output of the sensor, preventing blocking and coagulation and improving the initial charging ability;

(3) providing a toner composition by which fogging and scattering of the toner around the images are prevented in a reversed development method;

(4) providing a toner composition by which digital electrostatic latent images are reproduced precisely, whereby an image excellent in reproducibility of fine lines and grading are achieved;

(5) providing a toner composition with little fluctuation in charging;

(6) providing a toner composition for reversed development with durability and without entailing a filming phenomena of the toner to the organic photoconductive layer;

(7) providing an image forming method in which fogging and scattering of the toner particles around the images are avoided in a reversed development method; and (8) providing an image forming method in which a digital electrostatic latent image formed by laser light exposure is developed precisely, whereby reproducibility of the fine lines and formation of images having good grading are realized.

BRIEF DESCRIPTION OF THE DRAWINGS

This invention will be better understood and its numerous objectives and advantages will become apparent to those skilled in the art by reference to the accompanying drawings as follows.

DESCRIPTION OF THE PREFERRED EMBODIMENTS

Figure 1:
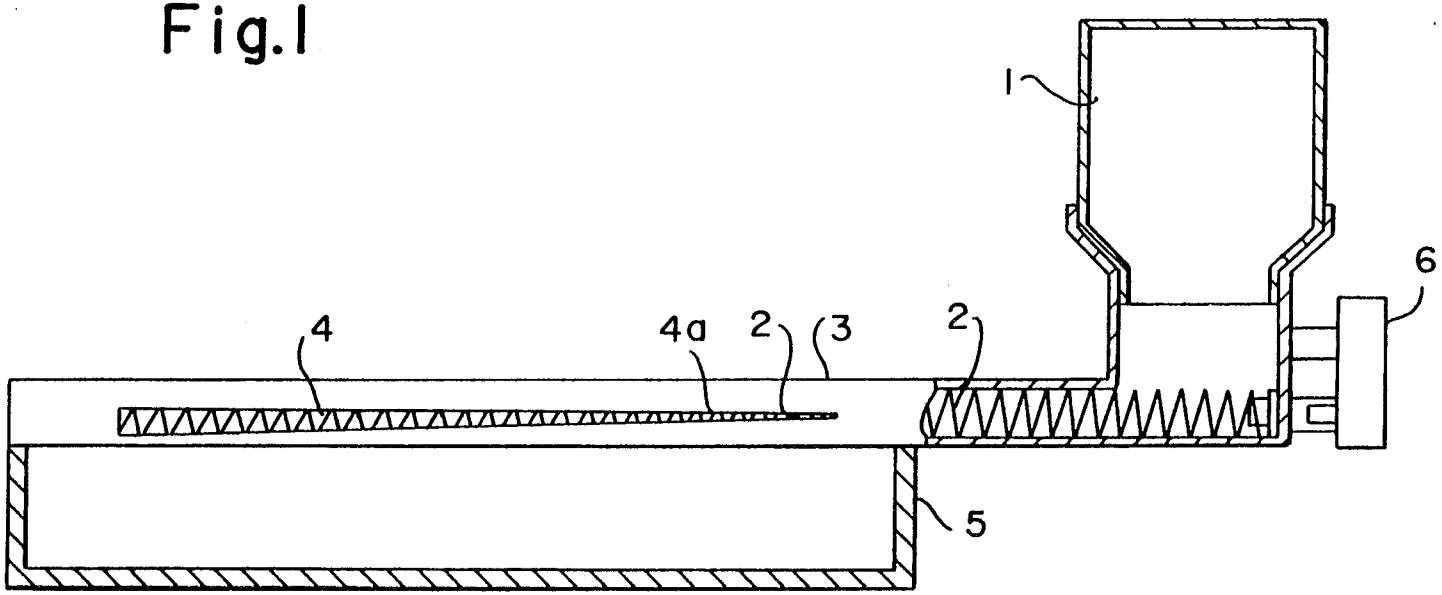
FIG. 1 shows a partial cross sectional view of the portions to feed the toner from the toner container to the developing apparatus.

The conventional fine powder of the silica is prepared by treating the surface of the same with a compound with relatively smaller molecular weight and having an alkyl group in the molecule. Hydrophobisity of such silica fine powder is, however, not sufficient. For example, fluidity of the toner composition, comprising fine toner particles with mean particle size of 10 μm or less and above-described fine powder of silica, is not sufficient.

The hydrophobic silica used in this invention can be prepared by treating the fine powder of silica with a compound having higher molecular weight of polymethylsilyl compound in the molecule compared with the conventional surface treating agent. Hydrophobicity of the hydrophobic silica thus prepared was observed to be largely improved. The toner composition comprising the hydrophobic silica and toner has excellent fluidity. Therefore, the toner composition displays an excellent fluidity even when a toner of very fine particle size is used or the composition is used under the circumstances of high temperature and high humidity.

The toner used in this invention is the conventional toner which is used for the development method in a dry state in the prior art, wherein additives such as colorants are dispersed in the resinous binder.

Various kinds of resinous binders can be used, electrification and adhering properties being taken into account.

These resinous binders include the olefine series of polymers such as stylene copolymers, acryl copolymers, stylene-acryl copolymers, polyethylene, chlorinated polyethylene, polypropylene, ionomers; and various kinds of polymers including polyvinyl chloride, polyester, polyamide, polyurethane, epoxy resin, diallyl phthalate resin, silicone resin, ketone resin, polyvinyl butyral resin, phenol resin, phenol resin modified by a rosin, xylene resin, maleic acid resin modified by a rosin, rosin ester and petroleum resin. Selection of these resins as a binder depends on a fixing method and the characteristics that are considered to be necessary. Of these resins, stylene polymers, acryl polymers and stylene-acryl copolymers are preferably used because of their grinding property and easy control of the molecular weight of the polymers, and stylene-acryl copolymers are used more preferably. Preferable mean molecular weight of the resins are in the range of from 30,000 to 200,000, and more preferably in the range of from 50,000 to 150,000. One kind of the resin or a mixture of two or more kinds of the resins can be used.

The charging property of the toner through friction can be improved by using rosin ester, phenol resin modified by a rosin, maleic acid resin modified by a rosin, epoxy resin, polyester, fibrous polymers and polyether resin among the above-described resins. Softening temperature of the resinous binders are preferably in the range of 50 to 200° C., and more preferably in the range of 70 to 170° C.

When a toner having a pressure fixing property is used, it is preferable to use a polymer which is deformed easily by pressure as a resinous binder including olefin polymers such as polyethylene and polypropylene, and polyamides. The other examples of resinous binders include, for example, polyvinyl acetate, ethylene-polyvinyl acetate copolymer, hydrogenated polyethylene, hydrogenated rosin ester, and aliphatic or aromatic petroleum resins.

Conventional toners, dies and pigments are used as colorants to be dispersed in the resinous binders.

The colorants include carbon black as black pigment, and the copper phthalocyanine series of cyan pigments, azo series of yellow pigments, azo series of magenta pigments and quinacridone series of magenta pigments as colored pigments.

Examples of the colorants include carbon black, Lamp Black, Chrome Yellow, Hanza Yellow, Benzidine Yellow, Beslene Yellow, Quinoline Yellow, Permanent Orange GTR, Pyrazone Orange, Pulcan Orange, Watchang Red, Permanent Red, Brilliant Carmin 3B, Brilliant Carmin 6B, Dupont-oil Red, Pyrazolone Red, Rysole Red, Rhodamine B Lake, Lake Red c, Rose Bengal, Aniline Blue, Ultramarine Blue, Chalco-oil Blue, Methylene Blue Chloride, Phthalocyanine Blue, Phthalocyanine Green, Malachite Green Octhalate and the like, and oil soluble dies such as C. I. Solvent Yellow 60, C. I. Solvent Red 27 and C. I. Solvent Blue 35.

These colorants can be used independently or as a mixture of two or more kind of pigments. The amount of the colorants to obtain a sufficient amount for the image density is, for example, preferably in the range of 0.1 to 50 parts by weight per 100 parts of the resinous binder, and more preferably in the range of 1 to 20 parts by weight.

Magnetic materials composed of magnetic bodies can be incorporated into the above-described toners to impart magnetization to the toner. The magnetic materials can be materials which show magnetization by themselves or are capable of being magnetized. Examples of these materials include metals exhibiting ferromagnetic properties such as ferrite, magnetite, iron, cobalt, nickel and manganese, or alloys thereof or metallic compounds including the above.

Examples further comprise triiron tetroxide, iron sesquioxide, iron-zinc oxide, iron-yttrium oxide, cadmium oxide, iron-copper oxide, neodymium oxide, iron-barium oxide, iron-magnesium oxide, iron-manganese oxide and lanthanum oxide.

Mean particle size of these magnetic materials is preferably in the range of 0.1 μm to 1 μm, and the materials can be used independently or in a mixed from of two or more kinds of these materials. The amount of the magnetic material is preferably in the range of 5 to 70 parts by weight per 100 parts by weight of the resinous binder, and more preferably in the range of 20 to 50 parts by weight.

The above-described toner can contain a charge regulating agent to regulate charges. Examples of the charge regulating agents include oil soluble dies such as Nygrocine Dye, Oil Black and Spyrone Black; metallic soaps such as manganese, ferrous or ferric, cobalt, nickel, lead, zinc, cerium and calcium salts of naphthenic acid, salicyclic acid, octyl acid, fatty acid and rosin acid; or metal containing azo dye, pyrimidine compound, and metal chelate of alkylsalicylic acid. The amount of the charge regulating agent can be in the range of 0.1 to 10 parts by weight per 100 parts of the resinous binder, and more preferably the amount can be in the range of 0.1 to 5 parts by weight.

The above-described toner further comprises offset inhibitors to inhibit adhesion of the toner onto the roller. Examples of the offset inhibitors include waxes such as low molecular weight polypropylene, low molecular weight polyethylene and paraffin wax; and low molecular weight olefin oligomer having a carbon number of four or more, fatty acid amides and silicone oil. The preferred amount of the offset inhibitor is in the range of 0.5 to 15 parts by weight per 100 parts by weight of the resinous binder.

Particle size of the toner in this invention is not restricted. However the range of the particle size is generally in the range of 1 to 30 μm, preferably in the range of 4 to 25 μm and more preferably in the range of 6 to 10 μm. Although toners of relatively small particle size can be used in this invention, a toner composition which can satisfy the objectives of the present invention is prepared when fine toner powder, mean particle size of which is in the range of around 6 to around 10 μm is used.

The toner composition in this invention can be prepared by using the above-described materials through the conventional manufacturing methods. The materials are made to melt and are kneaded by using a two-axis extruder or a roll mill and the like, and the kneaded material is cooled, ground and fractionated to give a toner composition having the above-described appropriate particle size distribution characteristics. Sometimes rounding and trimming treatments may be performed during the manufacturing process of the toner composition.

The hydrophobic silica used in this invention is prepared from the high purity fumed silica ($SiO_2$:99.8wt %) by treating with an organic silicone compound having a polymethylsily group in the molecule. The hydrophobicity of the hydrophobic silica is so strong that, when a toner composition is prepared by mixing the silica particles with the toner of the above-described particle size distribution, the particles of the hydrophobic silica disperse into the toner as primary particles, thereby improving the fluidity, charging stability through friction and stability in the atmosphere. As a consequence, the magnetic brushes imparted by an appropriate charge can be formed repeatedly.

Particle size of the hydrophobic silica is, in the particle size of the primary grains, in the range of 0.0001 to 0.1 μm, and particularly preferable in the range of 0.001 to 0.01 μm. Commercially available fine silica powder includes Cabosil-TS720 manufactured by Cabot Co.

The preferably amount of the added hydrophobic silica is in the range of 0.05 to 2.0 parts by weight per 100 parts by weight of the toner, and more preferably in the range of 0.5 to 1.0 parts by weight.

The toner composition of the present invention is prepared by mixing the above-described toner and hydrophobic silica.

A conventional surface treating agent used in the present field of the art other than the hydrophobic silica can also be blended with the toner composition in this invention. Especially hydrophilic alumina particles are preferably used. When alumina particles are included in the toner composition, the weight ratio of the hydrophobic silica to that of alumina particles is generally in the range of 1:0.2 to 1:3, and the ratio of 1:0.5 to 1:1 is particularly preferable.

The toner composition of the present invention can be used either for the single component development method or for the two component development method. When the composition is used for the single component development method, a developing agent is prepared by mixing the toner containing above-described magnetic material with the hydrophobic silica. When the composition is used for the two component development method, a developing agent is prepared by blending the mixture of the toner and hydrophobic silica with the magnetic carrier.

Particles composed of conventional magnetic materials can be used for the magnetic carriers. The materials include iron oxide, reduced iron, copper, nickel, cobalt, ferrites and the like; and alloys of them with zinc and aluminum. Of these materials, ferrite particles are particularly preferably. These ferrites includes zinc ferrites, nickel ferrites, copper ferrites, manganese ferrites, nickel-zinc ferrites, manganese-magnesium ferrites, copper-magnesium ferrites, manganese-zinc ferrites and manganese-copper-zinc ferrites and the like.

The magnetic carrier may be coated with resins or not coated. The coating resin of the magnetic carrier include stylene resins, acryl resins, silicone resins, fluoride resins, ketone resins, polyester resins, epoxy resins, melamine resins and polycarbonate resins. These resins are used separately or in the mixed form of two or more kind of the resins.

The particle size of the magnetic carrier is in the range of 50 to 120 μm, and that of in the range of 90 to 110 μm is preferable. The ratio of the magnetic carrier to the toner composition is, in weight ratio, in the range of 99:1 to 90:10, and particularly the mixture of 98:2 to 96:4 in the weight ratio can be used.

Development conditions in the image forming method of the present invention are as follows:

The amount of the charge on the toner as measured by a blow-off method is preferably in the range of ±15 to ±25 μc/g, and particularly preferable in the range of ±17 to ±23 μc/g. The surface charge of the image-holding body is preferably adjusted in the range of ±600 to ±800 V, and particularly in the range of ±650 to ±700 V. Bias voltage is preferably in the range of ±400 to ±550 V, and particularly preferable in the range of ±450 to ±500 V.

In the toner composition of the present invention, the quality of the image becomes good when an organic photoconductor with a resin layer on its surface is used as a image-holding body, thereby preventing the occurrence of the cleaning fault.

A toner composition well suited for the purpose of the reversed development of the digital electrostatic latent image is described hereinafter.

The toner composition of the present invention suited for the purpose of the reversed development of the digital electrostatic latent image comprises a toner having the particle size in the predetermined range and with a sharp particle size distribution profile, and a hydrophobic silica treated with a compound having the above-described polymethylsilyl group in the molecule.

The toner used in the toner composition should possess the following conditions.

(a) Mean particle size of the toner is at least in the range of 6 to 10 μm, and 70 wt % or more of the total particles are in the range of 0.6 to 1.2 times of the mean particle size.

(b) The relative amount of the fine toner particles with their particle size of less than 5 μm is 10 wt % or less based on the total amount of the toner, and the amount of the coarse particles with their particle size of 16 μm or more is 20 wt % or less based on the total amount of the toner.

Compressibility of the toner composition is preferably in the range of 35 to 40%.

When the toner composition filling the above-described conditions is subjected to the image forming method, the composition shows the advantages comprising: improving the decrease of fluidity by making the particle size of the toner composition small; making the amount of delivery stable between the drum and the sleeve; and keeping the amount of the toner and charge constant in the magnetic brush. As a consequence, the toner is transferred precisely to the charge attenuating portions of the image area recorded by the laser light, thereby making the contrast of the light and shade portions of the image distinct and the grading of the image excellent. A line image with constant resolution of the line width is also realized with good reproducibility of the original.

When the average particle size of the toner exceeds the above-described range, reproducibility of the images of the ultra-fine lines decreases, thereby reproducing images of poor resolution. When the mean particle size of the toner is smaller than the above-described range, coagulation of the toner in the toner container occurs by the marked decrease of the fluidity of the toner, or irregularity in the images arises because of the instability of the amount of the toner in the magnetic brush formed on the development sleeve.

Even when the mean particle size of the toner falls in the above-described range, mal-charged particles are made to be incorporated in the magnetic brush if 70 wt % or more of the total toner particles falls in the range of 0.6 to 1.2 times of the mean particle size, thereby entailing a decrease in the image density or the occurrence of overlapping images.

It is also important that the relative amount of the fine particles with a particle size of 5 μm or less, and that of the coarse particles with a particle size of 16 μm or more are in the above-described range. A toner composition having a good cleaning characteristic and excellent image forming ability is obtained by making the relative amounts based on the total amount of the toner in the prescribed range.

In the above-described toner composition, fluidity of it can be improved by adding the hydrophobic silica into the toner composition. Accordingly, even when the images are formed by using this toner composition under circumstances of high temperature and high humidity, the amount of the toner delivered to the developing apparatus is maintained at a constant level, preventing mal-charging of the toner during continuous copying and forming a magnetic brush having a constant amount of toner by supplying a toner having an appropriate amount of charge to the development sleeve. Deficiency in cleaning during the development process is also prevented effectively.

The amount of the hydrophobic silica is in general in the range of 0.05 to 2 parts by weight per 100 parts by weight of the above-described toner, and particularly the amount in the range of 0.1 to 0.5 parts by weight is preferable. Compressibility of the toner composition may be adjusted so as to be in the range of 35 to 40%, and particularly be in the range of 36 to 38%.

The toner composition whose compressibility is in the above-described range is excellent in mutual sliding ability by interposing the hydrophobic silica uniformly among the particles, thereby the toner assumes an appropriately compacted state.

The toner composition thus obtained can be maintained in a desirable state in supplying the toner from the toner container to the development sleeve, in stirring performance in the stirring portion of the development apparatus and in the dispersion ability of the toner in the magnetic brush.

When the compressibility is smaller than in the above-described range, the supplied amount of the toner composition from the toner container to the developing apparatus will be unstable. Excess supply of the toner will occur, causing scattering of the toner composition and fogging. When the compressibility of the toner composition is greater than in the above-described range, fluidity of the toner composition will decrease. Consequently, supply of the toner composition to the developing apparatus will be insufficient, causing deterioration in the image density and blocking in the stirring portion of the development, which entails adhesion of the toner to the development sleeve and stirring paddle. Compressibility is defined in this invention by the following relationship of [(compressed apparent specific gravity−loose apparent specific gravity) /compressed apparent specific gravity×100(%)], which represents the mutual mixing state of the powder. Loose apparent specific gravity and compressed apparent specific gravity were measured by using a powder tester manufactured by Hosokawa Micron Co.

EXAMPLES

The following describes the present invention with respect to the examples.

EXAMPLE 1

| Toner material | Parts by weight |
|---|---|
| stylene-acryl copolymer | 100 |
| carbon black | 12 |
| metallic azo dye with negative polarity | 2.0 |
| low molecular weight polypropylene | 1.5 |

After melting and kneading above-described materials, the mixture was cooled, ground and fractionated to obtain five kinds of toners having mean particle size of 7.5, 8.5, 9.5, 10.5 and 12 μm.

Fine powder of silica R-972 (trademark, manufactured by Nihon Aerosil Co., treated with hydrophobic alkyl group, mean particle size 0.001 μm) was blended in 0.5 parts by weight with 100 parts by weight of above-described five kinds of toners, respectively, preparing five kinds of toner compositions.

Next, 0.5 parts by weight of hydrophobic silica TS-720 (trademark, treated with a compound having polymethylsilyl group, manufactured by Cabot Co.) was blended with 100 parts by weight of above-described five kinds of toners, respectively, preparing five kinds of toner compositions.

Figure 2A:
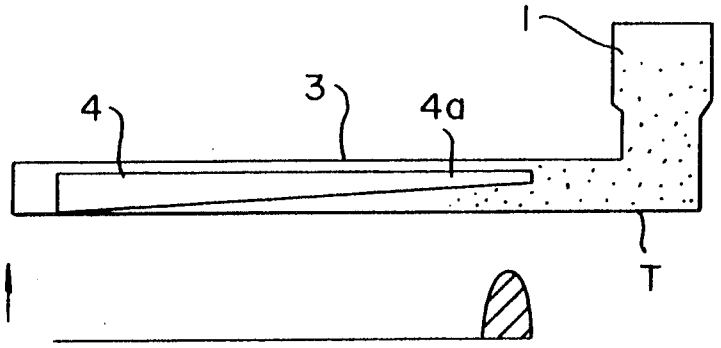
FIGS. 2(*a*) and 2(*b*) are illustrative figures showing the process during the feeding of the toner.
Figure 2B:
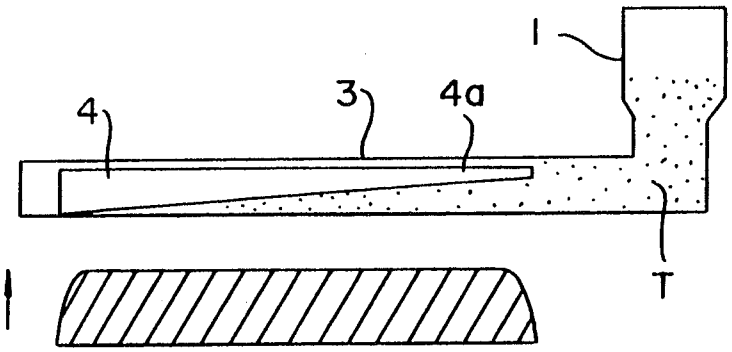

Fluidities of 10 kinds of toners prepared in the above-described experiments were tested by using a developing apparatus shown in FIG. 1 and FIG. 2.

The apparatus comprises a toner container 1, a pipe 3 in which a spiral screw 2 is equipped, and a developing apparatus 5 disposed at the lower part of a slit 4 formed in the pipe 3. The slit 4 is formed along the longitudinal axis of the pipe in a long triangular shape. The height of the open gate 4*a* of the slit 4 at the toner container 1 side is high while the height of the open gate 4*a* is gradually lowered as it leaves the toner container 1. Accordingly, the toner T delivered from the toner container 1 to inside of the pipe 3 by the rotating action of the spiral screw 2 falls from a higher position in the pipe 3 through the slit 4 at the toner container 1 side, while it falls from a lower position in the pipe 3 through the slit 4 at the remote position from the toner container 1.

As is shown in FIG. 2(*a*), toner T is delivered successively from the toner container 1 into the pipe 3 and falls down into the developing apparatus 5 through the slit 4 when the spiral screw 2 is made to rotate by the driving mechanism 6. When the rotation of the spiral screw 2 is going on, toner T reaches the spearhead of the pipe 3 and, as is shown in FIG. 2(*b*), toner T is released through the entire open gate of the slit 4*a*.

Since the rotating motion of the spiral screw 2 is regulated by a signal transferred from the magnetic sensor as is described before, toner T is released through the slit 4 in accordance with the rotation of the spiral screw 2 when toner concentration decreases. When the toner concentration reaches the predetermined value, rotation of the spiral screw 2 halts and hence delivery of the toner T stops. By these mechanisms, the amount of the toner T dropping from the slit 4 balances with the amount of the toner T delivered from the toner container 1, and hence height of the toner T surface in the pipe 3 is maintained at a predetermined level.

In this developing apparatus, the toner container and toner delivery system are not disposed directly above the developing apparatus, and toner delivery is not achieved by the rotation of a sponge roller and the like having the length equal to the length of the developing apparatus. Rather, toner T is delivered along the longitudinal direction in the pipe 3 to release the toner into the developing apparatus 5. Consequently, the toner to be used for this type of apparatus is required to have a high level of fluidity.

| Test conditions | | |
|---|---|---|
| toner composition in the toner container | | 100 g |
| inner diameter of the pipe | | 15 mm |
| slit length | | 250 mm |
| slit width | toner container side | 3 mm |
| | developing agent delivery side | 15 mm |

The amount of toner release was measured when the amount of toner release reached a constant value after the rotation of the spiral screw started, as was shown in FIG. 2(*b*). The measuring circumstances were under normal temperature and humidity (20° C., 60%) and high temperature and humidity (35° C., 85%). The results are shown in FIG. 3 and FIG. 4.

Figure 4:
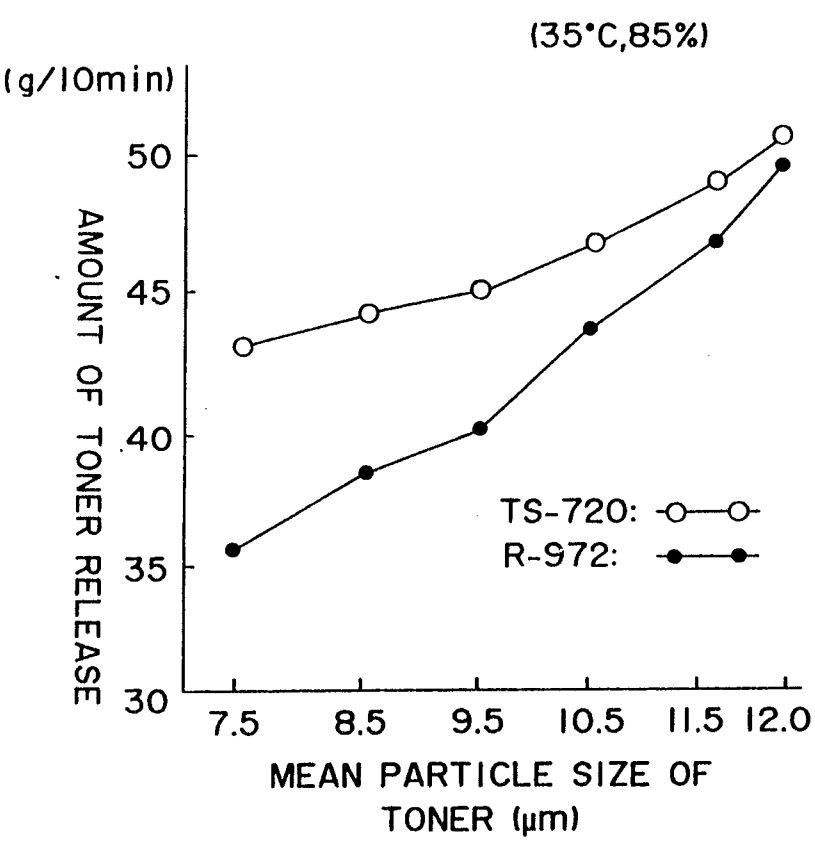
FIG. 4 shows the amount of the toner release as a function of the mean particle size of the same under the conditions of high temperature and high humidity.
Figure 3:
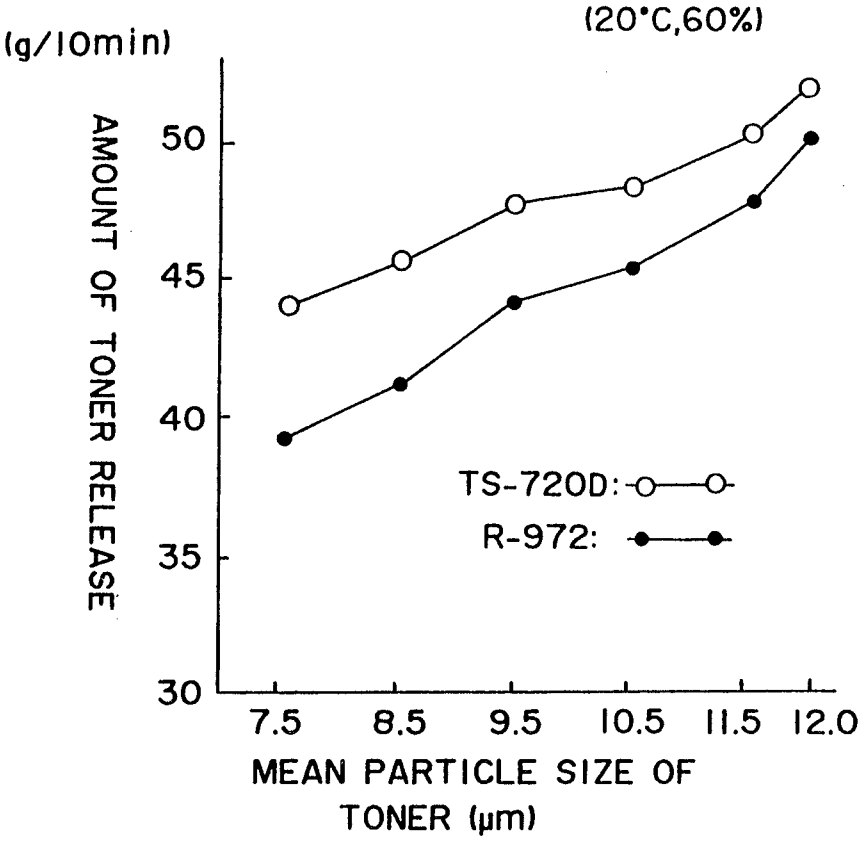
FIG. 3 shows the amount of the toner release as a function of the mean particle size of the same under the conditions of constant temperature and humidity.
Figure 5:
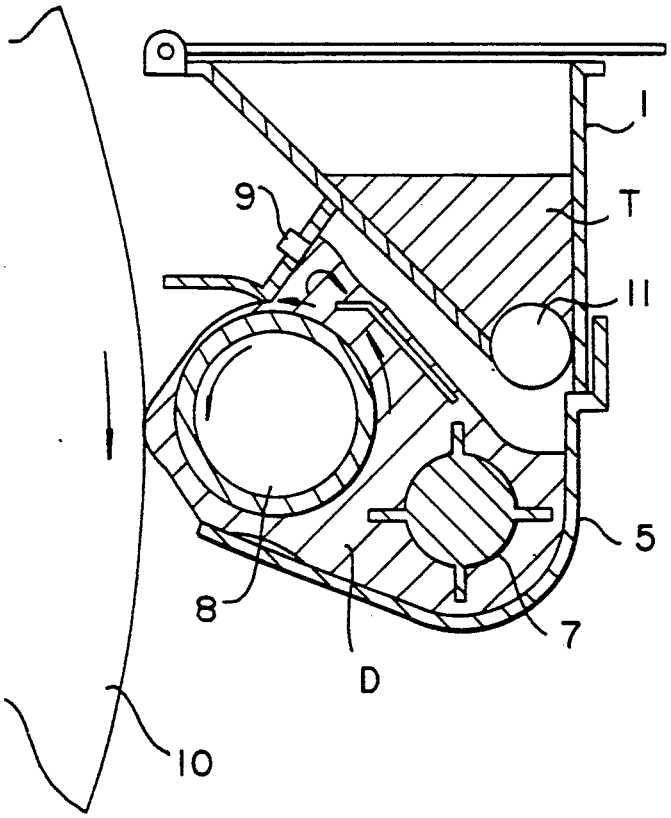
FIG. 5 is a schematic view of a development mechanism using a magnetic brush method.

As are apparent from FIG. 3 and FIG. 4, fluidity of the toner composition containing a hydrophobic silica (TS-720) is largely improved under the circumstances of normal temperature and humidity or high temperature and humidity, compared with the toner composition containing a conventional silica fine powder (R-972), resulting in an increase of the amount of the released composition. Particularly, in the toner compositions containing the toners with their particle size of 9.5 μm or less, the difference between the amount of the released toner composition of this invention and that of the conventional one was remarkable. The difference was much more distinct under the circumstances of high temperature and high humidity.

EXAMPLE 2

A toner having mean particle size of 8.5 μm prepared in Example 1 was blended and dispersed with fine silica powder of R-972 or TS-720 in the weight ratios shown in Table 1, thereby obtaining the toner compositions. Fluidities of the toner composition obtained were measured by using the developing apparatus in the same method as in Example 1. The releasing rate of the compositions (g/10 min.) are listed in Table 1.

TABLE 1

| Fine powder of silica | R-972 | TS-720 |
|---|---|---|
| 0 wt % | 15.4 | 15.4 |
| 0.3 wt % | 40.4 | 44.0 |
| 0.5 wt % | 41.1 | 45.5 |

The results shown in Table 1 indicate that fluidities of the toner compositions are largely improved even when the amount of the added hydrophobic silica is small.

EXAMPLE 3

| Toner material | Parts by weight |
|---|---|
| stylene-acryl copolymer | 100 |
| carbon black | 8.5 |
| low molecular weight polypropylene Biscol 550P (trade mark, Sanyo Kasei Co.) | 1.8 |
| charge regulating agent, Bontron S-34 (trademark, Orient Kagaku Co.) | 10 |

The toner materials described above were melted and kneaded together and the mixture was cooled, ground and fractionated to give a toner of mean particle size of 8.5 μm, wherein particle size distribution of 75 wt % of the toner based on the total particles was in the range of 5.1 pm to 10.2 μm, the relative amount of the toner with the coarse powder of a particle size of 16 μm or more was 0 wt % and that of the fine powder of the particle size of 5 pm or less was 3 wt %.

One hundred parts by weight of the toner was mixed with 0.5 parts by weight of the hydrophobic silica TS-720 (trademark, Cabott Co.) and 0.5 parts by weight of hydrophilic alumina [aluminum oxide C (trademark, Nihon Aerosil Co.)] by using a Henshell mixer to give a toner composition.

The toner composition obtained was blended with a ferrite carrier of mean weight particle size of 104 μm coated by a acryl polymer in the weight ratio of 3:97, thereby preparing a developing agent.

Copy tests were carried out under the development conditions described in Table 2 by using the above-described toner composition and a reconstructed electrophotographic copying machine DC-1605 (trade mark, Mita Kogyo Co.) equipped with an exposure apparatus using a semiconductor laser beam. The results are listed in Table 2.

EXAMPLE 4

The toner materials as were used in Example 3 were melted and kneaded together and the mixture was cooled, ground and fractionated to give a toner of mean particle size of 7.5 μm, wherein particle size distribution of the 80 wt % of the toner based on the total particles was in the range of 4.5 μm to 9.0 μm, the relative amount of the toner with the coarse powder of particle size of 16 μm or more was 0 wt % and that of the fine powder of the particle size of 5 μm or less was 7 wt %.

A developing agent was prepared by the same method described in Example 3, except that 100 parts by weight of the toner was mixed with 0.7 parts by weight of hydrophobic silica TS-720 (trademark, Cabott Co.) and 0.5 parts by weight of hydrophilic alumina particles [aluminum oxide C (trademark, Nihon Aerosil Co.)] using a Henshell mixer.

Copy tests were carried out by using the developing agent prepared under the development conditions listed in Table 2. The results are described in Table 2.

EXAMPLE 5

The toner materials as were used in Example 3 were melted and kneaded together and the mixture was cooled, ground and fractionated to give a toner of mean particle size of 9.5 μm, wherein particle size distribution of the 74 wt % of the toner based on the total particles was in the range of 5.7 μm to 11.4 μm, the relative amount of the toner with the coarse powder of a particle size of 16 μm or more was 1 wt % and that of the fine powder of the particle size of 5 μm or less was 2 wt %.

One hundred parts by weight of the toner was mixed with 0.5 parts by weight of hydrophobic silica TS-720 (trademark, Cabott Co.) and 0.5 parts by weight of hydrophilic alumina particles [aluminum oxide C (trademark, Nihon Aerosil Co.)] using a Henshell mixer to give a toner composition.

The toner composition obtained was blended with a ferrite carrier of mean weight particle size of 90 μm coated by an acryl polymer in the weight ratio of 3:97, thereby preparing a developing agent.

Copy tests were carried out using the developing agent thus obtained under the development conditions described in Table 2. The results are described in Table 2.

COMPARATIVE EXAMPLE 1

The toner materials as were used in Example 3 were melted and kneaded together and the mixture was cooled, ground and fractionated to give a toner of mean particle size of 10.5 μm, wherein particle size distribution of the 60 wt % of the toner based on the total particles was in the range of 6.3 μm to 12.6 μm, the relative amount of the toner with the coarse powder of a particle size of 16 μm or more was 5 wt % and that of the fine powder of the particle size of 5 μm or less was 3 wt %.

A developing agent was prepared by the same method described in Example 3, except that the toner of this example was used.

Copy tests were carried out by using the developing agent obtained under the development conditions described in Table 2. The results are described in Table 2.

COMPARATIVE EXAMPLE 2

A developing agent was prepared by the same method described in Example 3, except that 100 parts by weight of the toner obtained by the method described in Example 3 and 0.5 parts by weight of a hydrophobic silica R-972 (trademark, mean particle size 0.001 μm, Nihon Aerosil Co.) were used.

Copy tests were carried out by using the developing agent obtained under the development conditions described in Table 2. The results are described in Table 2.

COMPARATIVE EXAMPLE 3

The toner materials as were used in Example 3 were melted and kneaded together and the mixture was cooled, ground and fractionated to give a toner of mean particle size of 7.2 μm, wherein particle size distribution of the 72 wt % of the toner based on the total particles was in the range of 4.3 μm to 8.5 μm, the relative amount of the other with the course powder of the particle size of 16 μm or more was 0 wt % and that of the fine powder of the particle size of 5 μm or less was 11 wt %.

A developing agent was prepared by the same method used in Example 3, except that 100 parts by weight of the toner of this example was mixed with 1.0 part by weight of a hydrophobic silica TS-720 (trademark, Cabott Co.) and 0.5 parts by weight of hydrophilic alumina particles [aluminum oxide C (trademark, Nihon Aerosil Co.)] using a Henshell mixer.

Copy tests were carried out by using the developing agent obtained under the conditions described in Table 2. The results are described in Table 2.

COMPARATIVE EXAMPLE 4

The toner materials as were used in Example 3 were melted and kneaded together and the mixture was cooled, ground and fractionated to give a toner of mean particle size of 5.8 μm, wherein particle size distribution of the 80 wt % of the toner based on the total particles was in the range of 3.5 μm to 7.0 μm , the relative amount of the toner with the coarse powder of a particle size of 16 μm or more was 0 wt % and that of the fine powder of the particle size of 5 μm or less was 20 wt %.

A developing agent was prepared by the same method used in Example 3, except that 100 parts by weight of the toner of this example was mixed with 1.0 part by weight of a hydrophobic silica TS-720 (trademark, Cabott Co.) and 0.5 parts by weight of hydrophobic alumina particles [aluminum oxide C (trademark, Nihon Aerosil Co.)] using a Henshell mixer.

Copy tests were carried out by using the developing agent obtained under the conditions described in Table 2. The results are described in Table 2.

TABLE 2

| | | | Example 3 | Example 4 | Example 5 | Comparative Example 1 | Comparative Example 2 | Comparative Example 3 | Comparative Example 4 |
|---|---|---|---|---|---|---|---|---|---|
| Toner composition | Central particle size (μm) | | 8.5 | 7.5 | 9.5 | 10.5 | 8.5 | 7.2 | 5.8 |
| | 0.6 × central particle size - 2 × central particle size (%) | | 77 | 80 | 74 | 60 | 77 | 72 | 83 |
| | Less than 5 μm (%) | | 3 | 7 | 2 | 3 | 3 | 11 | 20 |
| | 16 μm or more (%) | | 0 | 0 | 1 | 5 | 0 | 0 | 0 |
| | Silica | | TS-120 | TS-120 | TS-120 | TS-120 | TS-972 | TS-120 | TS-120 |
| | (parts by weight) | | 0.5 | 0.7 | 0.3 | 0.5 | 0.5 | 1.0 | 1.0 |
| | Compressibility (%) | | 37.5 | 38.6 | 36.3 | 34.6 | 42.1 | 39.1 | 41.0 |
| Development condition | Particle size of carrier (μm) | | 104 | 104 | 90 | 104 | 104 | 104 | 80 |
| | Photoconductor | | OPC | OPC | OPC | OPC | OPC | OPC | OPC |
| | Surface potential (V) | | −690 | −650 | −670 | −690 | −690 | −650 | −670 |
| | Bias potential (V) | | −480 | −470 | −460 | −480 | −480 | −470 | −470 |
| | D-S distance (mm) | | 0.8 | 0.7 | 0.8 | 0.8 | 0.8 | 0.7 | 0.7 |
| Evaluation of the image | Image density | Initial | 1.45 | 1.39 | 1.42 | 1.44 | 1.41 | 1.35 | 1.41 |
| | | 20,000 sheets | 1.41 | 1.38 | 1.33 | 1.29 | 1.22 | 1.08 | 1.33 |
| | Half-tone reproducibility | Initial | Excellent | Excellent | Excellent | Good | Excellent | Excellent | Excellent |
| | | 20,000 sheets | Excellent | Excellent | Good | Poor | Good | Poor | Good |
| | Resolution (no./mm) | Initial | 6.8 | 7.5 | 6.3 | 5.0 | 6.8 | 6.8 | 6.8 |
| | | 20,000 sheets | 6.8 | 7.5 | 5.0 | 4.5 | 6.3 | 5.0 | 6.3 |
| | Fog density | Initial | 0.001 | 0.001 | 0.002 | 0.003 | 0.002 | 0.001 | 0.005 |
| | | 20,000 sheets | 0.001 | 0.001 | 0.005 | 0.011 | 0.015 | 0.033 | 0.023 |

TABLE 2-continued

| | Example 3 | Example 4 | Example 5 | Comparative Example 1 | Comparative Example 2 | Comparative Example 3 | Comparative Example 4 |
|---|---|---|---|---|---|---|---|
| Irregularity in the image | None | None | None | Observed | Observed | Observed | Observed |
| Fault in cleaning | None | None | None | None | $1 \times 10^4$ | $1 \times 10^4$ | $1.5 \times 10^4$ |
| Charge (μc/g) (initial→$2 \times 10^4$) | 19→22 | 20→21 | 22→25 | 21→31 | 19→28 | 22→33 | 21→28 |

The evaluation methods of the image quality in the items described in Table 2 are as follows:

(1) Image densities and fog densities were described in the measured values obtained by using a reflection photodensitometer.

(2) Half tones were evaluated visually with reference to standard copies.

(3) Resolution of the images were expressed by the numbers of the fine line images reproducible in 1 mm width.

(4) Irregularities in the images were evaluated visually by observing the differences in the image density and image resolution among the center, both sides and top and bottom ends of the copy sheet.

(5) Cleaning faults were expressed by the numbers of the copy sheets when the cleaning faults occurred.

The results described in Table 2indicate that good quality of the images is maintained over a long period of use when copies are performed by using the toner compositions obtained in Examples 3–5. On the other hand, copying operations using the toner compositions obtained in Comparative Examples 1–3 cause problems and deficiencies as the copying operations are repeated, comprising; decrease in the image density, deterioration in the resolution, irregularity in the image quality and faults in cleaning.

It is understood that various other modifications will be apparent to and can be readily made by those skilled in the art without departing from the scope and spirit of this invention. Accordingly, it is not intended that the scope of the claimed appended hereto be limited to the description as set forth herein, but rather that the claims be constructed as encompassing all the features of patentable novelty that reside in the present invention, including all featured that would be treated as equivalents thereof by those skilled in the art to which this invention pertains.

What is claimed is:

1. A toner composition for developing an electrostatic latent image on an image-holding body, comprising:

toner having an mean particle size of about 6 to 10 μm and a toner particle distribution wherein 70% or more of the toner is 0.6 to 1.2 times of the mean particle size, the amount of toner particles having a diameter of 5 μm or less is at most 10 wt % and the amount of toner particles having a diameter of 16 μm or more is at most 2 wt %; and hydrophobic silica treated with a compound including a polymethylsilyl group in an amount of about 0.05 to 2 parts by weight per 100 parts by weight of toner.

2. A toner composition according to claim 1, wherein the toner composition has a negative chargeability.

3. A toner composition according to claim 1, wherein said toner composition further comprises fine particles of hydrophilic alumina.

4. A toner composition according to claim 3, wherein the proportion of said hydrophobic silica to said hydrophilic alumina in said toner composition is in the range of 1:0.2 to 1:3.

5. A toner composition according to claim 1, wherein the compressability of said toner composition is in the range of 35 to 40%.

6. An image forming method comprising the steps of: imparting a charge on the image-holding body by a charging method; forming an electrostatic latent image on the image-holding body by exposing an image by a digital exposure method on the image-holding body imparted by a charge; converting a latent image on the image-holding body into a toner image by a development method containing a toner composition; and transferring the toner image on the image-holding body to a copy material by a transfer means, wherein said toner composition comprises a toner and a hydrophobic silica treated with a compound having a polymethylsilyl group in the molecule.

7. An image forming method according to claim 6, wherein said image-holding body is an organic photoconductor.

* * * * *